US007059074B1

(12) United States Patent
Calvete Zumalde

(10) Patent No.: US 7,059,074 B1
(45) Date of Patent: Jun. 13, 2006

(54) MUZZLE-LOADING FIREARM

(75) Inventor: Angel Calvete Zumalde, Zamudio-Bilbao (ES)

(73) Assignee: Ardesa S.A., Zhmudio (ES)

( * ) Notice: Subject to any disclaimer, the term of this patent is extended or adjusted under 35 U.S.C. 154(b) by 0 days.

(21) Appl. No.: 11/051,282

(22) Filed: Feb. 4, 2005

(51) Int. Cl.
*F41C 7/00* (2006.01)

(52) U.S. Cl. ..... 42/51; 42/32

(58) Field of Classification Search ..... 42/51, 42/32, 69.01
See application file for complete search history.

(56) References Cited

U.S. PATENT DOCUMENTS

| | | | | |
|---|---|---|---|---|
| 4,121,364 | A * | 10/1978 | Kaltenegger | 42/32 |
| 6,604,311 | B1 | 8/2003 | Laney et al. | |
| 6,922,932 | B1 * | 8/2005 | Hengstenberg et al. | 42/51 |
| 2004/0134112 | A1 * | 7/2004 | Lizarralde et al. | 42/51 |

* cited by examiner

*Primary Examiner*—J. Woodrow Eldred
(74) *Attorney, Agent, or Firm*—Fulwider Patton LLP

(57) ABSTRACT

A muzzle-loading firearm has a barrel, a frame part, a breech plug, and a firing pin housing arranged adjacent to the rear end of the breech plug. The firing pin housing is pivotally connected to the frame part such as to be pivotable in a plane perpendicular to the barrel, between a closed position in which the firing pin housing covers the rear end of the breech plug, and an open position in which the firing pin housing does not cover the rear end of the breech plug.

23 Claims, 9 Drawing Sheets

MUZZLE-LOADING FIREARM

FIELD OF THE INVENTION

The invention relates generally to muzzle-loading firearms.

BACKGROUND OF THE INVENTION

Because of their classical character, muzzle-loading firearms are popular among sport enthusiasts. For shooting with this kind of firearms, normally, a primer is applied to a rear end of a breech plug inserted in one end of the barrel (the breech end of the barrel), and this primer is used to ignite a powder charge situated inside the barrel, at a front end of said breech plug, whereby front end means the end closest to the muzzle and the rear end the end furthest away from the muzzle.

A problem involved with this kind of firearms is the access to the rear end of the breech plug, which must be accessed in order to insert a primer, to replace a used primer or the withdraw a primer when unloading the firearm. Further, access to the breech plug should preferably be easy in order to allow for easy cleaning of the corresponding parts of the firearm.

Traditionally, access to the breech plug has sometimes required the barrel to be removed, which, of course, may represent an inconvenience.

US-B1-6604311 discloses a lever-operated breech block, which can be pivoted to a removed position in which the user can directly access the breech plug. However, this pivoting mechanism involves a large number of movable parts and interrelated components, which may imply high manufacturing costs and a certain risk for mechanical problems. Thus, one of the objectives of the present invention is to provide for an alternative way of accessing the breach plug or corresponding parts of a firearm. Other objectives of the invention are to provide an improved coupling of the barrel to a body, frame or stock portion or part of the firearm, and to provide an improved block or safety mechanism for preventing accidental detonation of the primer.

SUMMARY OF THE INVENTION

The invention relates to a muzzle-loading firearm comprising:

- a barrel having a front end corresponding to a muzzle of the barrel, and a rear end;
- a frame part arranged to receive the barrel and to be connected to the barrel (at the rear end thereof);
- a breech plug arranged at the rear end of the barrel (for example, inserted into said rear end of the barrel, for example, screwed into said rear end of the barrel), said breech plug having a rear end arranged to receive a primer, and a front end (the powder charge is to positioned in correspondence with this front end, so as to be ignited by the primer, through a channel or similar provided in the breech plug);
- a firing pin housing arranged adjacent to the rear end of the breech plug, said firing pin housing housing a firing pin in a longitudinal firing pin channel of said firing pin housing, whereby the firing pin is arranged so that it can be displaced between a front position (in which, when the firearm is in use, it actuates on the primer, causing it to detonate and thus to ignite the powder charge) and a rear position in said firing pin channel (where the firing pin is withdrawn with regard to the primer).

The firing pin housing is pivotally connected to the frame part such as to be pivotable in a plane perpendicular to the barrel (that is, "sidewards"), between a closed position in which the firing pin housing covers the rear end of the breech plug with the firing pin channel aligned with said breech plug (and with the primer, when the primer has been attached to the rear end of the breech plug), and an open position in which the firing pin housing does not cover the rear end of the breech plug. In this open position, the user can access the breech plug, for example, in order to insert a new primer and/or to remove a used primer. Thus, access to the breech plug is provided without any need for tilting the firing mechanism including hammer and trigger, etc. That is, the present invention provides for an extremely simple and reliable means for accessing the breech plug.

The firing pin housing can be pivotally arranged around a shaft pin extending in a direction parallel with the barrel. The shaft pin can be provided with a radial flange or similar, for facilitating manual removal of said shaft pin in order to remove the firing pin housing. The shaft pin can also have a conically shaped front end, for facilitating insertion of the shaft pin into a corresponding channel of the frame part and into the firing pin housing.

The firing pin housing can include a recess arranged to receive a tip of a locking pin when the firing pin housing is in its closed position, for retaining the firing pin housing in said closed position. The locking pin can be biased into said recess by a locking pin spring. With an adequately shaped recess and/or locking pin, it is possible to achieve that a certain minimum force has to be exerted on the firing pin housing in order cause it to move (to tilt) towards its open position, forcing the locking pin to retract against the force exerted by the locking pin spring. The firing pin housing can be provided with a projecting portion for facilitating tilting of the firing pin housing from its closed to its open position.

The firearm can further comprise a pivotally arranged hammer arranged to pivot between a rear position in which a contact portion of said hammer is withdrawn or retracted with regard to the firing pin, and a fire position in which said contact portion contacts the firing pin so as to push it against the primer. A rear end of the firing pin housing can comprises a disc element, and the firing pin can have a wider portion arranged to be biased against said disc element by means of a firing pin spring, and further a rear portion thinner than said wider portion. The disc element can comprise a through hole dimensioned to receive said rear portion, and the contact portion of the hammer can be dimensioned and arranged so as to enter the through hole when the hammer is in the fire position, so as to push the firing pin against its front position in order to actuate on the primer.

The firearm can further comprise a first hammer spring arranged to push the hammer from the rear position towards the fire position, and a second hammer spring arranged to push the hammer rearwards from the fire position. That is, the two springs exert opposed forces on the hammer. The first hammer spring can be arranged to exert pressure on the hammer so as to force the hammer towards the fire position during a first portion of movement of the hammer from the rear position to the fire position, and not to exert such pressure on the hammer during a last portion of said movement of the hammer from the rear position to the fire position; for this purpose, the first hammer spring can be arranged to be prevented from following the hammer to the fire position by a first hammer spring retention means. In this way, it can be achieved that the hammer moves by inertia during the last portion of the movement towards the fire position, against the force exerted by the second hammer spring. Thereby, it can be achieved that the second hammer spring can, once the hammer (due to inertia of the movement initially caused by the force exerted by the first hammer spring) has reached and displaced the firing pin, force the hammer to return to a "neutral" position, between the rear position and the fire position. In this neutral position, the forces exerted by the first and second hammer springs are balanced, so that the hammer tends to remain in said neutral position.

The first hammer spring and the second hammer spring can thus be selected and arranged so that after firing the firearm, the hammer is moved rearwards from the fire position by the second hammer spring, to said neutral position.

The firearm can further comprise a pivotally arranged trigger biased against a hammer blocking position and pivotable between said hammer blocking position and a hammer releasing position, the trigger having a hammer contact portion arranged so that when the trigger is in the hammer blocking position, said hammer contact portion can, depending on the position of the hammer, selectively abut against a first retention configuration of the hammer, so as to keep the hammer in the rear position, or against a second retention configuration of the hammer, so as to prevent the hammer from passing from a neutral position, in which the hammer is substantially balanced by the first hammer spring and the second hammer spring, to the fire position.

The first retention configuration can be shaped so as to allow the hammer contact portion to be displaced from a first position (corresponding to the hammer blocking position of the trigger), in which the hammer contact portion abuts against said first retention configuration, to a second position (corresponding to the hammer releasing position of the trigger), in which it does not abut against said first retention configuration thus allowing the hammer to pass from the rear position to the fire position, by means of pulling the trigger so as to displace it from its hammer blocking position to its hammer releasing position.

The second retention configuration can be substantially hook-shaped, for receiving the hammer contact portion if the hammer is urged towards the fire position without the trigger being pulled.

The trigger can be biased against the hammer blocking position by said first hammer spring.

The firearm can further comprise a blocking pin displaceable between a trigger blocking position, in which the pin prevents the trigger from moving to the hammer releasing position, and a trigger releasing position, in which it does not prevent the trigger from moving to the hammer releasing position. For this purpose, the trigger blocking pin can be provided with a recess for receiving a blocking profile of the trigger when the blocking pin is in the trigger releasing position.

The trigger, the hammer, the first hammer spring and the second hammer spring can all be arranged in a removable cassette, so that these parts can be jointly removed with the cassette, for example, in connection with cleaning of the firearm.

The barrel can be provided with a projection arranged for guiding the barrel in a guide groove in the frame part, when mounting the barrel to the frame part. Said projection can comprise a substantially prismatic body fixed (for example, welded) to the barrel. The projection can comprise at least two threaded holes for receiving respective screws (such as Allen screws) by means of which the barrel can be fastened to the frame part. The barrel can further be provided with a further projection including a threaded hole for receiving a screw by means of which a barrel-protector can be fastened to the barrel; this barrel-protector can serve to allow the user to support the firearm during use, without having the grip the barrel directly.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures.

DETAILED DESCRIPTION OF THE INVENTION

Figure 9:
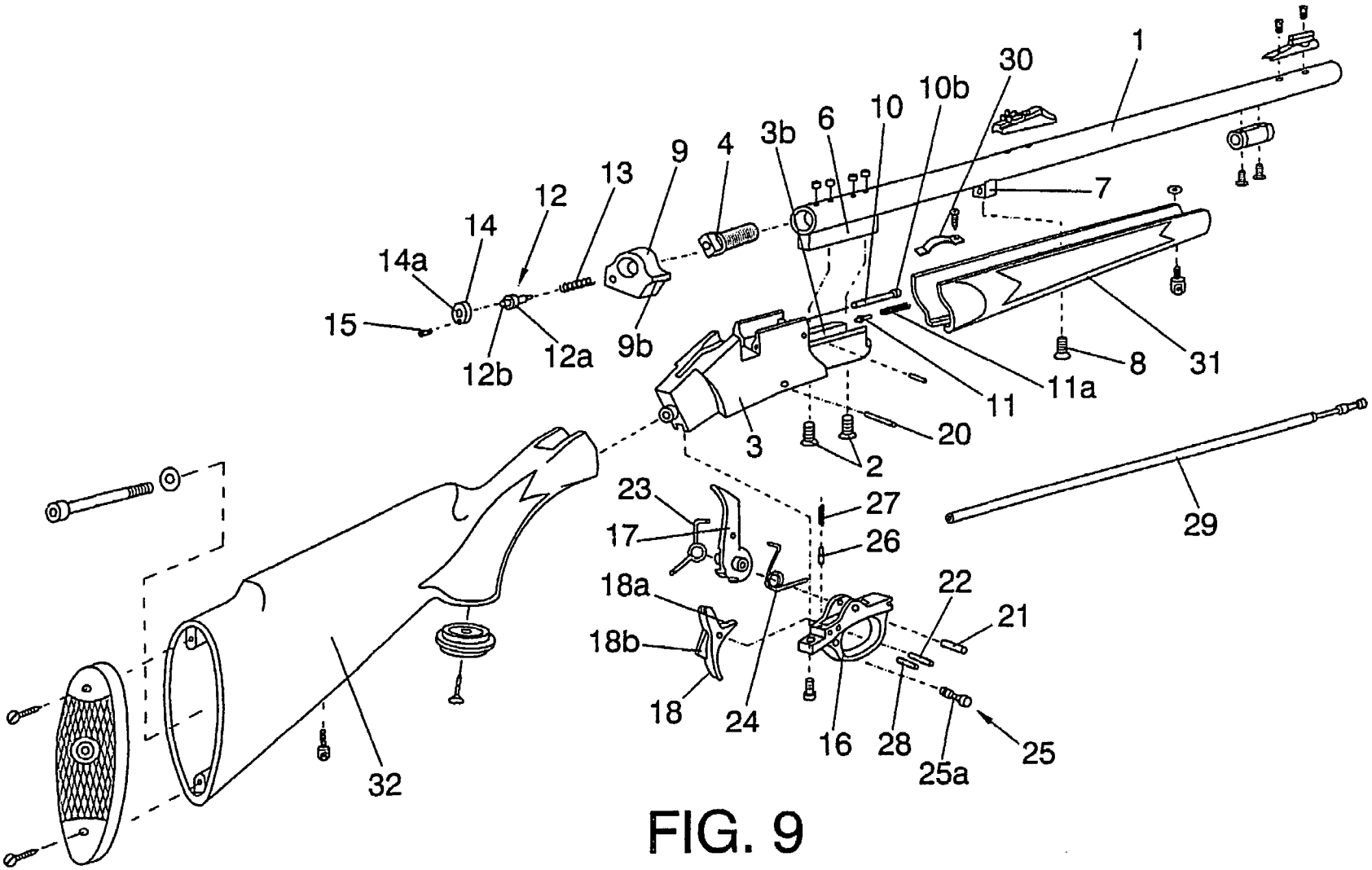
FIG. 9 is an exploded view of the firearm, showing some of its components.

FIG. 9 shows an exploded view of the firearm. The barrel 1 has a front or muzzle end and a rear end arranged to be received by a frame part 3. A breech plug 4 is arranged to be screwed into the rear end of the barrel. The breech plug has a rear end arranged to receive a primer 5 (cf., for example, FIG. 1) and a front end, against which the powder charge is applied when the firearm is loaded through the muzzle end of the barrel. The barrel is provided with conventional aiming means and other conventional accessories, well-known to the skilled person and that do not need to be further discussed herein.

A substantially prismatic body 6 is welded to the rear end of the barrel and is designed to fit into a guide groove 3*b* in the frame part 3. Thus, when mounting the barrel 1 to the frame part 3, said prismatic body 6 is inserted into the groove 3*b*, whereby it acts as a guiding means for the barrel, sliding along the groove until a rear end 6*a* (cf. FIG. 1) of said prismatic body 6 abuts against a corresponding support surface of the frame part. Thus, the prismatic body 6 allows for a correct and stable positioning of the barrel with respect to the frame part. Once in its correct position, the barrel is fastened to the frame part by means of two Allen screws 2 which are inserted into respective threaded holes 6*b* in the prismatic body 6.

A barrel-protector 31 is attached to the barrel by a screw 8 inserted into a threaded hole in a projection 7 from the barrel. The firearm further comprises a ramrod 29 arranged to be housed under the barrel, within the housing constituted by the barrel-protector. A ramrod retention spring 30 is provided to exert pressure on the ramrod when inserted under the barrel, to prevent it from being accidentally removed.

A conventional butt 32 is attached to a rear end of the frame part 3.

Figure 1:
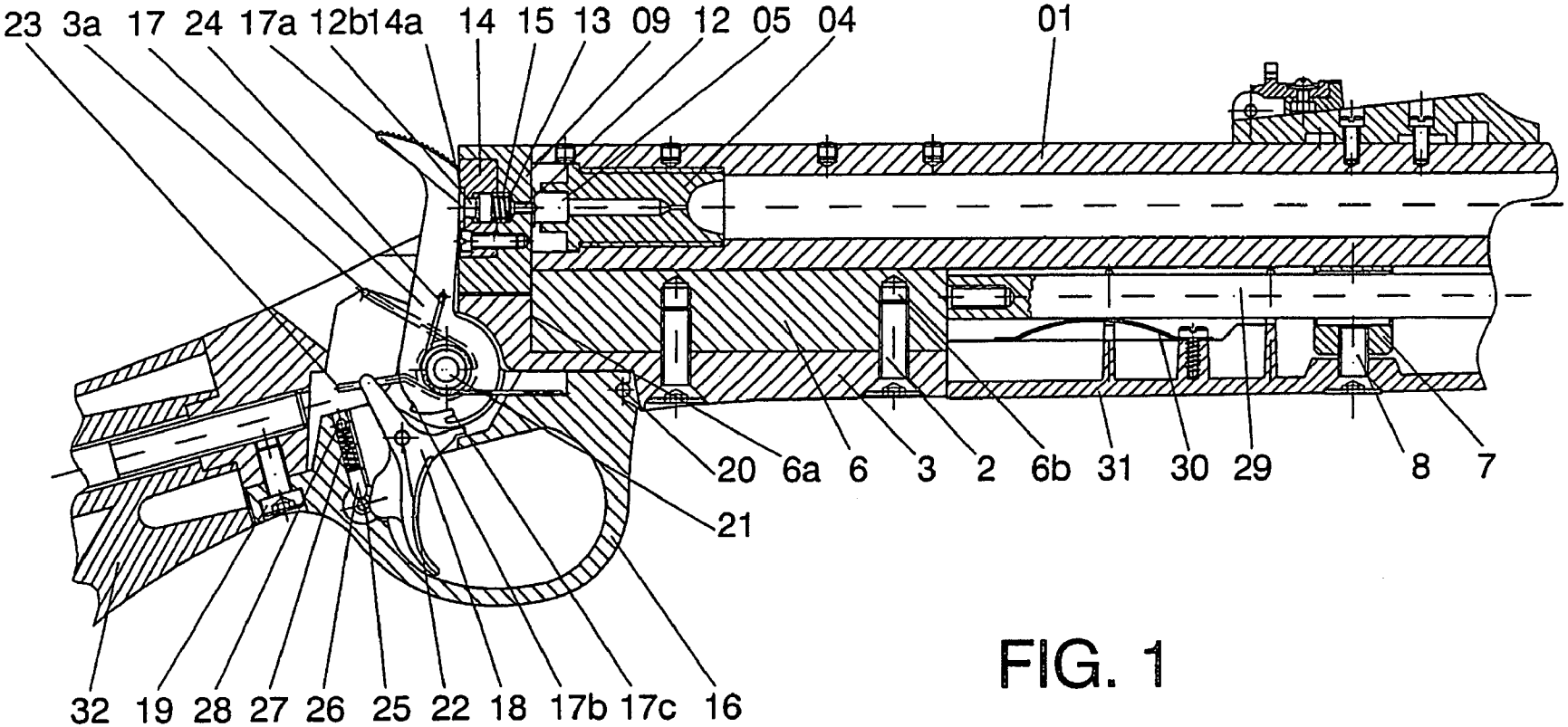
FIG. 1 is a vertical right side elevational view of a partial longitudinal cross section of the firearm according to a preferred embodiment of the invention, with the hammer in the fire position
Figure 2:
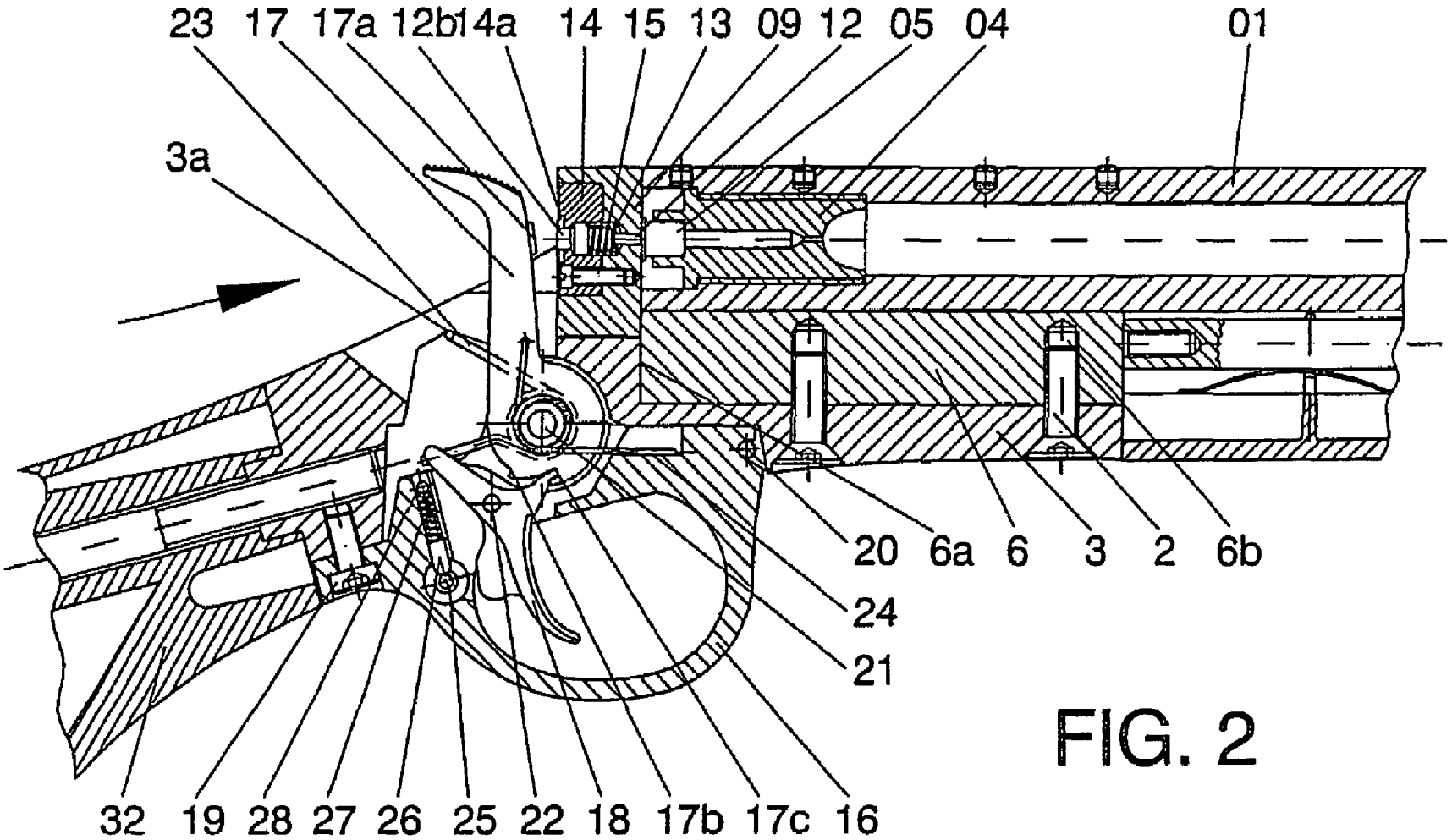
FIG. 2 is a view similar to FIG. 1 but with the hammer forced forward but blocked by a safety arrangement

A firing pin housing 9 is arranged adjacent to the rear end of the breech plug 4. The firing pin housing 9 houses a firing pin 12 in a longitudinal firing pin channel of said firing pin housing 9, whereby the firing pin 12 is arranged so that it can be displaced between a front position (in which it actuates on a primer 5 inserted into the breech plug, as shown in FIG. 1) and a rear position (shown in, for example, FIG. 2) in said firing pin channel.

A rear end of the firing pin housing 9 is provided with a disc element 14 closing the firing pin channel at its rear end. The firing pin 12 has a wider portion 12*a* arranged to be biased against said disc element 14 by means of a firing pin spring 13. The firing pin 12 further has a rear portion 12*b* thinner than said wider portion 12*a*. The disc element 14 comprises a through hole 14*a* dimensioned so that said rear portion 12*b* can enter said through hole 14*a*, while said wider portion cannot enter said through hole. Thus, when the hammer 17 is not acting on the firing pin 12, the firing pin 12 is in its rear position, biased by the firing pin spring 13, the rear end of the wider portion abutting against the disc element 14. The disc element is attached to the firing pin housing 9 by means of a screw 15. The hammer is provided with a contact portion 17*a* dimensioned and arranged so as to enter the through hole 14*a* when the hammer is in its fire position (see below), thus pushing the firing pin against its front position, that is, from the position shown in FIG. 2 to the position shown in FIG. 1.

Figure 8A:
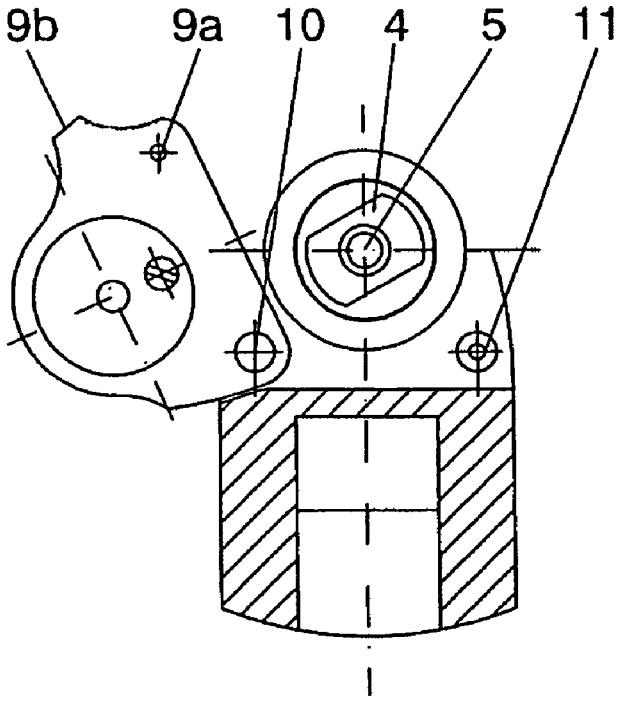
FIG. 8A is a vertical rear elevational cross section of the firearm, schematically showing the firing pin housing in the open position.
Figure 8B:
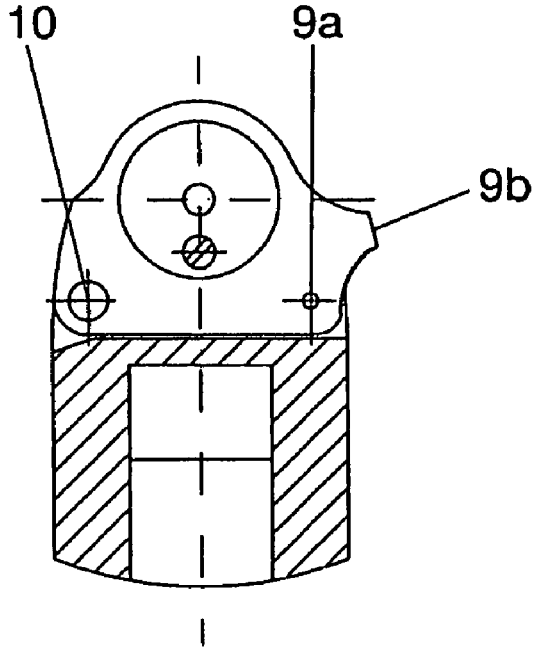
FIG. 8B is a view similar to FIG. 8A but with the firing pin housing in its closed position.

The firing pin housing 9 is pivotally connected to the frame part 3 such as to be pivotable in a plane perpendicular to barrel 1, between a closed position (shown in FIG. 8B) in which the firing pin housing 9 covers the rear end of the breech plug 4 (with the firing pin channel aligned with said breech plug), and an open position (shown in FIG. 8A) in which the firing pin housing 9 does not cover the rear end of the breech plug, thus allowing access to the breech plug, for example, in order to insert or remove the primer 5.

The firing pin housing 9 is pivotally arranged around a shaft pin 10 (cf. FIGS. 1, 7, 8A and 8B) extending in a direction parallel with the barrel 1. The shaft pin 10 is provided with a radial flange 10*b* for facilitating manual removal of said shaft pin (without any need for any specific tool) and with a conical front end 10*a* for facilitating insertion of the shaft pin 10 in a corresponding shaft pin channel (not shown in the drawings) in the frame part and in the firing pin housing.

A front portion of the firing pin housing 9 is provided with a recess 9*a* arranged to receive a tip of a locking pin 11 when the firing pin housing 9 is in its closed position. The locking pin 11 is biased into said recess 9*a* by a locking pin spring 11*a*. The recess 9*a* has a sloped or bevelled side wall which makes it possible to force the locking pin to move backwards against the force of the locking pin spring 11*a*, by means of manually forcing the firing pin housing 9 to pivot towards its open position.

The firing pin housing 9 is provided with a projecting portion 9*b* for facilitating manual tilting of the firing pin housing 9 from its closed to its open position, including overcoming the force exerted by the locking pin spring 11*a*.

The firearm further comprising a pivotally arranged hammer 17 arranged to pivot (around a hammer pivot pin 21) between a retracted or rear position in which the above-mentioned contact portion 17*a* of said hammer is withdrawn with regard to the firing pin 12, and a fire position in which said contact portion 17*a* enters into the through hole 14*a* in the disc 14 and thus contacts the firing pin, forcing it to move against the biasing force exerted by the firing pin spring 13. Two springs are provided for controlling the movement of the hammer, namely, a first hammer spring 23 arranged to push the hammer 17 from the rear position towards the fire position, and a second hammer spring 24 arranged to push the hammer rearwards from the fire position. The first hammer spring 23 is arranged to exert pressure on the hammer 17 so as to force the hammer towards the fire position only during a first portion of movement of the hammer from the rear position to the fire position (namely, during the portion corresponding to the movement of the hammer from the position shown in FIG. 4 to the position shown in FIG. 3), and not to exert such pressure on the hammer during a last portion of said movement of the hammer (namely, from the position shown in FIG. 3 to the position shown in FIG. 1) from the rear position to the fire position.

This is achieved by a first hammer spring retention means 3*a* (cf. FIG. 1) consisting in a flange or similar means provided for inside the frame part 3, and arranged so that once the hammer reaches a "neutral" position between said rear position and said fire position, an end of the first hammer spring 23 abuts against said retention means 3*a*, whereby it is prevented from "following" the hammer. The rest of the movement of the hammer against its fire position (shown in FIG. 1) takes place due to the inertia of the hammer, and against the force exerted by the second hammer spring (which thus must be selected so as not to provide a force that would impede the hammer from reaching the fire position due to its inertia).

The firearm further comprises a trigger 18 biased (by the first hammer spring 23) towards a hammer blocking position and pivotable (around a trigger pivot pin 22) between said hammer blocking position and a hammer releasing position. The trigger has a hammer contact portion 18*a* arranged so that when the trigger is in the hammer blocking position, said hammer contact portion 18*a* can, depending on the position of the hammer, selectively abut against a first retention configuration 17*b* of the hammer, so as to keep the hammer in the rear position, or against a second retention configuration 17*c* of the hammer, so as to prevent the hammer 17 from passing from a neutral position (cf. FIG. 3), in which the hammer is substantially balanced by the first hammer spring 23 and the second hammer spring 24, to the fire position.

The first hammer spring 23 and the second hammer spring 24 are selected and arranged so that after firing the firearm, the hammer is moved rearwards from the fire position by the second hammer spring 24, to said neutral position.

The first retention configuration 17*b* is shaped so that the hammer contact portion 18*a* can be displaced from a first position, in which the hammer contact portion 18*a* abuts against said first retention configuration 17*b*, to a second position, in which it does not abut against said first retention configuration 17*b* thus allowing the hammer to pass from the rear position to the fire position, by means of pulling the trigger 18, thus displacing the trigger from its hammer blocking position to its hammer releasing position.

Figure 3:
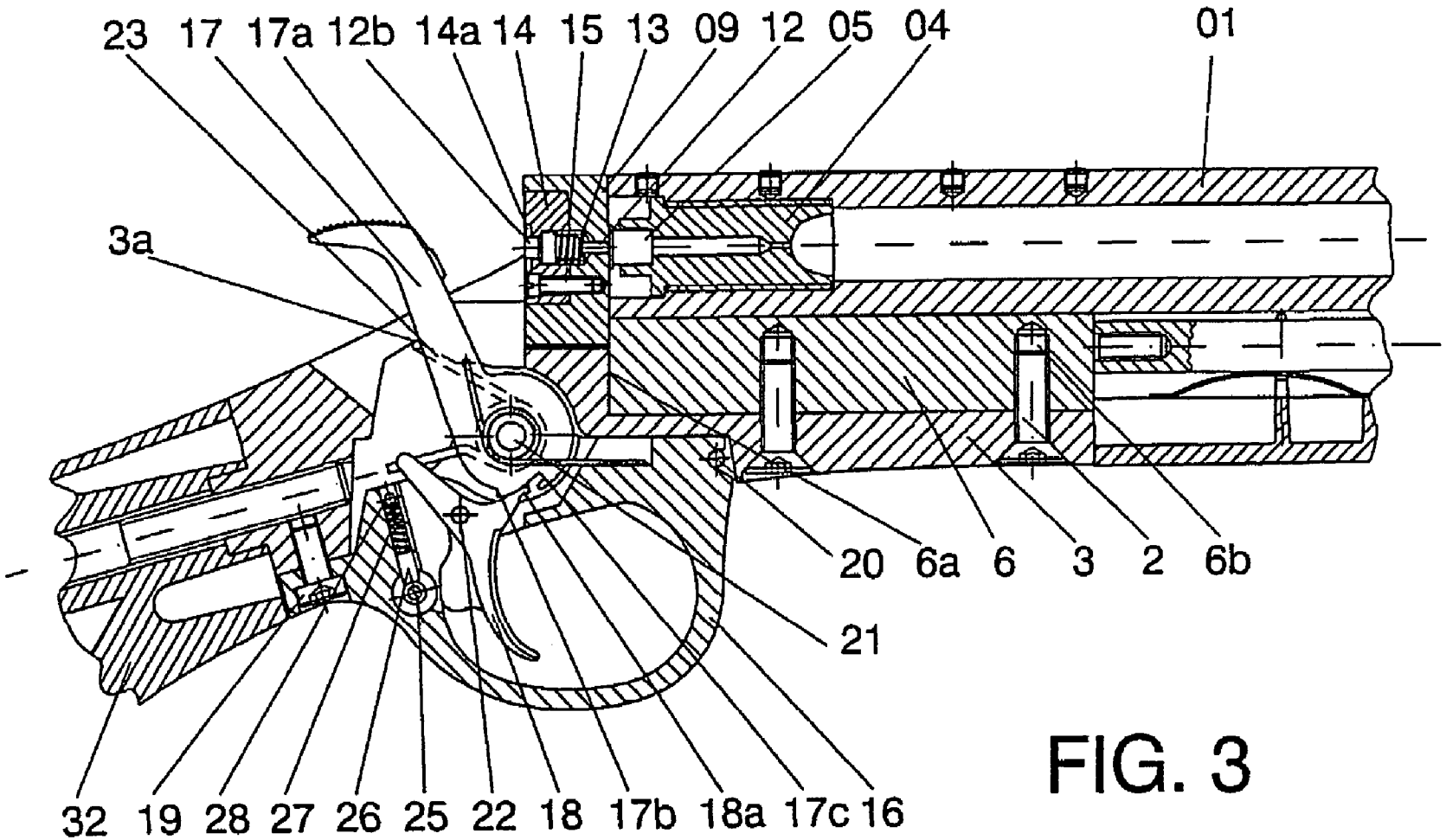
FIG. 3 is a view similar to FIG. 1 but with the hammer in a neutral position

The second retention configuration 17*c* is substantially hook-shaped for receiving the hammer contact portion 18*a* in case of the hammer being urged towards the fire position without the trigger being pulled. After firing the firearm, the second hammer spring 24 forces the hammer backwards, towards its neutral position, that is, to the position where it is balanced by the two hammer springs. In that position, the hammer contact portion 18*a* of the trigger 18 will be positioned immediately behind the "hook" of the second retention configuration, as shown in FIG. 3.

The firearm further comprises a blocking pin 25 displaceable between a trigger blocking position, in which the pin prevents the trigger from moving to the hammer releasing position, and a trigger releasing position, in which it does not prevent the trigger from moving to the hammer releasing position. The trigger blocking pin 25 is provided with a recess 25*a* for receiving a blocking profile 18*b* of the trigger when the blocking pin is in the trigger releasing position. Thus, the trigger can only be pulled so as to fire the firearm when the trigger blocking pin 25 is in its trigger releasing position. The trigger blocking pin is provided with bevelled surfaces arranged to cooperate with a pin 26. A spring 27, supported by another pin 28, biases the pin 26 against the trigger blocking pin. The trigger blocking pin 25 is shaped so that the interaction between its bevelled surfaces and the pin 26 causes the trigger blocking pin 25 two be substantially stable in the trigger releasing position and in the trigger blocking position, so that a certain minimum force must be exerted on the trigger blocking pin to move it from one of said positions to the other, and whereby a "click" effect is achieved when the trigger blocking pin 25 enters into any of said positions.

The trigger 18, the hammer 17, the first hammer spring 23, the second hammer spring 24 and the trigger blocking pin 25 are arranged in a cassette 16 (which can further comprise the triggerguard). The cassette, when in its mounted position (that is, when mounted to the firearm so that the firearm is ready to be used), is supported at its front end by a pin 20 fitting into a notch arranged at said front end of the cassette. A screw 19 arranged at the rear end of the cassette is used for locking the cassette in said mounted position. By removing the screw, the cassette can be separated from the rest of the firearm, whereby the user can access several parts of the firearm, for example, for cleaning them.

Figure 5:
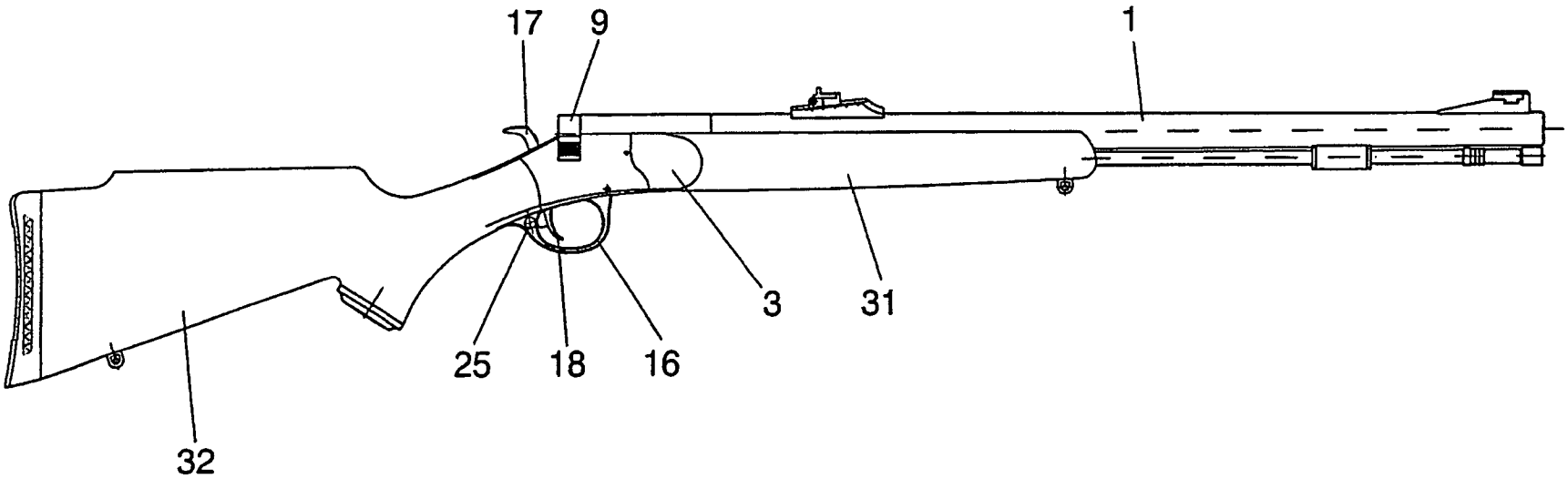
FIG. 5 is a vertical right side elevational view of the firearm.
Figure 6:
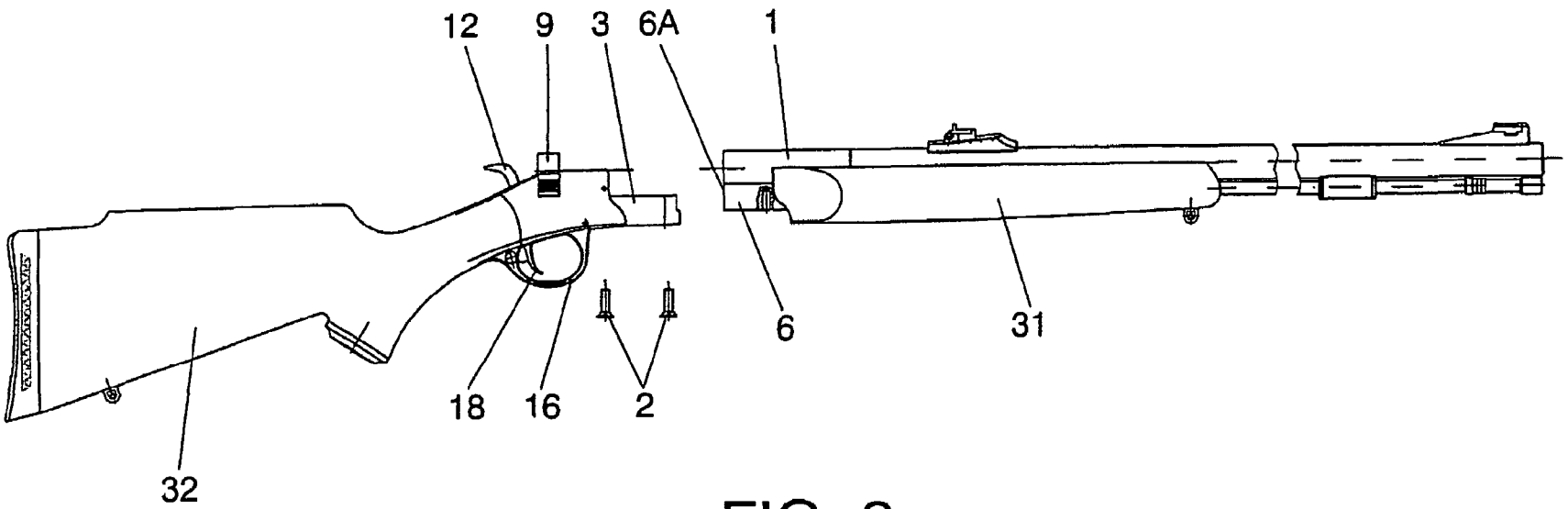
FIG. 6 is a view similar to FIG. 5 but with the barrel dismounted.
Figure 7:
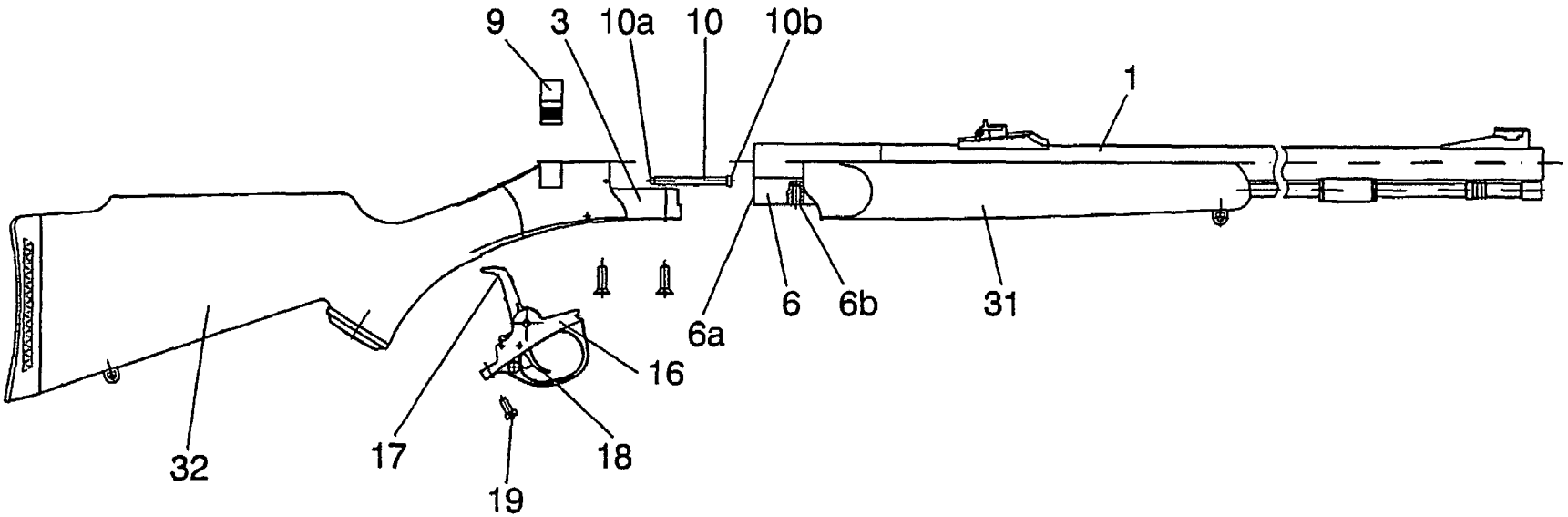
FIG. 7 is a view similar to FIG. 6 but with the firearm partly dismounted.

FIG. 7 schematically illustrates the firearm dismounted into some of its major components or groups of components, namely, the frame part 3 (including the butt 32), the barrel 1 (attached to the barrel-protector 31), the firing pin housing 9, and the cassette 16 with the trigger 18 and hammer 17. In FIG. 6, the cassette 16 and the firing pin housing 9 have been attached to the frame part 3. In FIG. 5, the barrel has been attached to the frame part, by means of sliding the projection 6 along the guide groove 3*b* in the frame part 3, until the rear end 6*a* of the projection abuts against the frame part.

Figure 4:
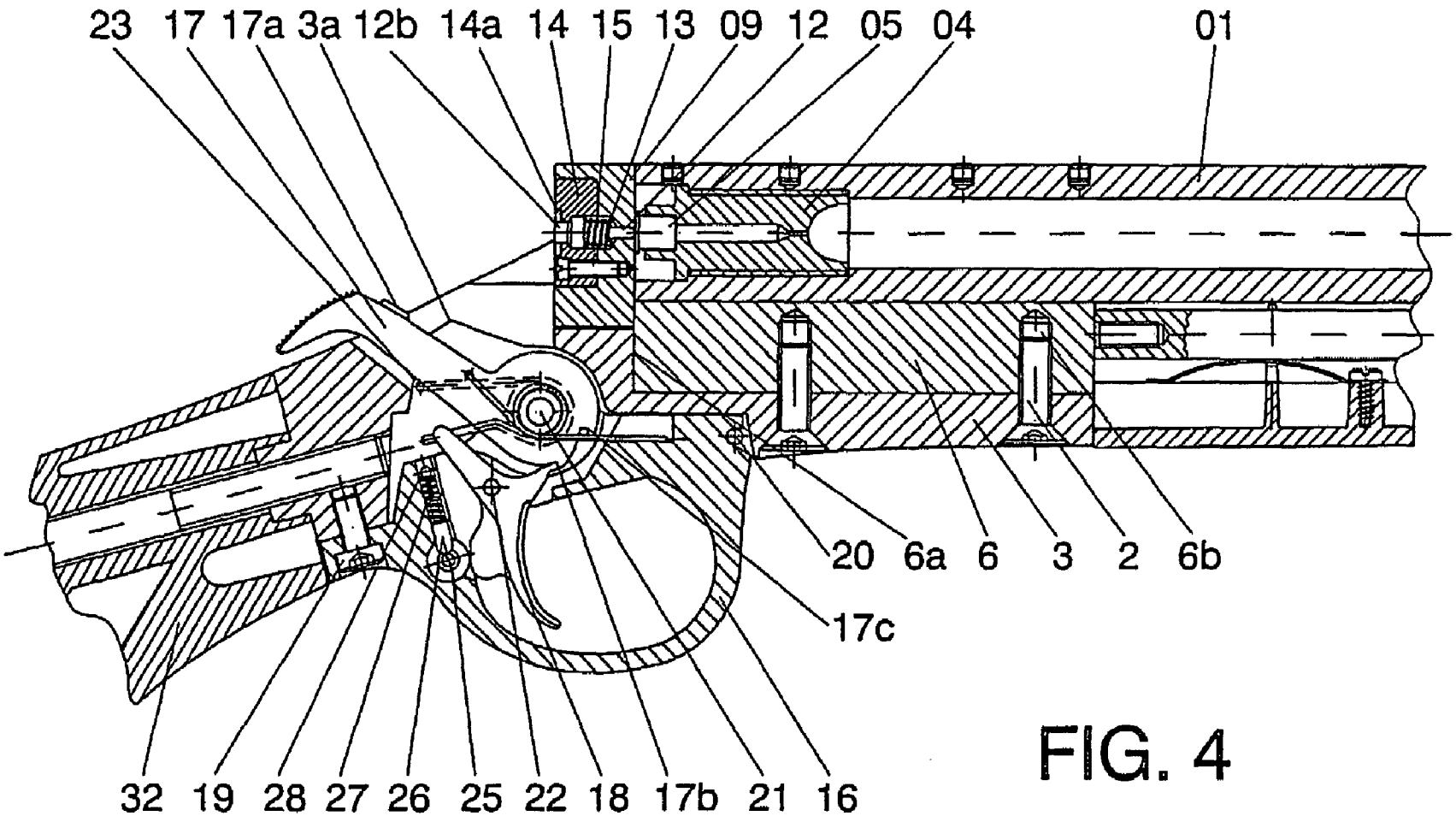
FIG. 4 is a view similar to FIG. 1 but with the hammer in a rear or retracted position, prior to pulling of the trigger.

Now, when using the firearm, the following sequence can be followed:

1) First, the hammer 17 is manually retracted to its rear position, illustrated in FIG. 4. In this position, the contact portion 17*a* is withdrawn with regard to the firing pin 12. The firing pin is biased against the disc 14, the rear portion 12*b* being housed in the through hole 14*a* of said disc.

The hammer is retained in its rear position by means of the hammer contact portion 18*a* of the trigger 18, which abuts against the first retention configuration 17*b* of the hammer. The trigger is in its hammer blocking position, towards which it is biased by the first hammer spring 23.

In order to fire the firearm, the trigger must be displaced to the trigger releasing position. This requires the trigger blocking pin 25 to be in its trigger releasing position, so that the trigger blocking profile can enter the corresponding recess 25*a* in the trigger blocking pin, thus allowing the trigger to be pulled backwards, against the force exerted by the first hammer spring, to the hammer releasing position of the trigger 18, in which the hammer contact portion 18*a* of the trigger no longer abuts against the first retention configuration of the hammer.

2) When the trigger reaches its hammer releasing position, the hammer contact portion 18*a* of the trigger no longer prevents the hammer 17 from leaving its rear position. Thus, due to the force exerted on the hammer by the first hammer spring 23, the hammer is forced to move forwards (against the substantially weaker force exerted by the second hammer spring), towards the position in which the hammer contacts the firing pin. However, before contacting the firing pin, the hammer reaches a position, shown in FIG. 3, in which an end of the first hammer spring 23 contacts the first hammer spring retention means 3*a* (such as a flange or similar surface configuration corresponding to the frame part), whereby the first hammer spring 23 ceases to exert its force on the hammer 17.
3) However, due to its inertia and due to the comparatively weak force exerted by the second hammer spring 24, the hammer continues to move towards the firing pin, until the hammer contact portion reaches and enters the through hole 14*a*, pushing the firing pin 12 towards its front position, wherein the firing pin actuates on the primer 5, in the position illustrated in FIG. 1. The primer is thus activated and ignites the powder charge situated at the opposite end of the breech plug 4.
4) However, immediately after having pushed the firing pin 12, the hammer is displaced in the opposite direction, "backwards", due to the force exerted by the second hammer spring 24, until the hammer reaches its neutral position, substantially as in FIG. 3, with the hammer being "balanced" by the first 23 and second 24 hammer springs. Now, in this position, the hammer contact portion 18*a* of the trigger is situated slightly behind the hook-shaped second retention configuration 17*c*.
5) With the hammer in this neutral position, and assuming that the hammer is accidentally forced to move "forwards" towards the firing pin, it will reach the position illustrated in FIG. 2. In this position, the hammer 17 is prevented from continuing its movement against the firing pin as the hammer contact portion 18*a* of the trigger cooperates with the second retention configuration 17*c*. Also, in this position, it is impossible to pull the trigger, as the hook-shaped second retention configuration prevents the trigger from pivoting.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

LIST OF THE REFERENCE NUMERALS USED IN THE DRAWINGS

1 barrel
2 screws
3 frame part
3*a* hammer spring retention means
3*b* guide groove in frame part, for receiving projection at rear end of barrel
4 breech plug
5 primer
6 projection (in the form of a substantially prismatic body) welded to the barrel, for guiding the barrel in the frame part and for fastening the barrel to the frame part
6*a* rear end of the projection (prismatic body)
6*b* threaded holes
7 projection for fastening the barrel to the barrel-protector
8 screw
9 firing pin housing
9*a* recess in firing pin housing
9*b* projecting portion of the firing pin housing
10 shaft pin
10*a* conical front end of shaft pin
10*b* flange portion of shaft pin
11 locking pin
11*a* locking pin spring, for biasing the locking pin into the recess 9*a*
12 firing pin
12*a* wider portion of firing pin
12*b* rear portion of firing pin
13 firing pin spring
14 disc element
14*a* through hole in disc element, for receiving the rear portion of the firing pin and the contact portion of the hammer
15 screw
16 cassette
17 hammer
17*a* contact portion of the hammer, arranged to act on the firing pin
17*b* first retention configuration
17*c* second retention configuration
18 trigger
18*a* hammer contact portion
18*b* trigger blocking profile
19 screw
20 pin supporting the cassette
21 hammer pivot pin
22 trigger pivot pin
23 first hammer spring
24 second hammer spring
25 trigger blocking pin
25*a* recess in trigger blocking pin
26 pin
27 spring
28 pin
29 ramrod
30 ramrod retention spring
31 barrel-protector
32 butt

I claim:

1. A muzzle-loading firearm comprising:

a barrel having a front end corresponding to a muzzle of the barrel, and a rear end;

a frame part arranged to receive the barrel and to be connected to the barrel, a breech plug arranged at the rear end of the barrel, said breech plug having a rear end arranged to receive a primer, and a front end;

a firing pin housing arranged adjacent to the rear end of the breech plug, said firing pin housing housing a firing pin in a longitudinal firing pin channel of said firing pin housing, whereby the firing pin is arranged displaceable between a front position and a rear position in said firing pin channel;

the firing pin housing being pivotally connected to the frame part such as to be pivotable in a plane perpendicular to the barrel, between a closed position in which the firing pin housing covers the rear end of the breech plug with the firing pin channel aligned with said breech plug, and an open position in which the firing pin housing does not cover the rear end of the breech plug.

2. The firearm according to claim 1, wherein the firing pin housing is pivotally arranged around a shaft pin extending in a direction parallel with the barrel.

3. The firearm according to claim 2, wherein said shaft pin is provided with a radial flange for facilitating removal of said shaft pin.

4. The firearm according to claim 3, wherein the shaft pin further comprises a conically shaped front end for facilitating insertion of the shaft pin.

5. The firearm according to claim 1, wherein the firing pin housing includes a recess arranged to receive a tip of a locking pin when the firing pin housing is in its closed position.

6. The firearm according to claim 5, wherein the locking pin is biased into said recess by a locking pin spring.

7. The firearm according to claim 1, wherein the firing pin housing is provided with a projecting portion for facilitating tilting of the firing pin housing from its closed towards its open position.

8. The firearm according to claim 1, further comprising a pivotally arranged hammer arranged to pivot between a rear position in which a contact portion of said hammer is withdrawn with regard to the firing pin, and a fire position in which said contact portion contacts the firing pin.

9. The firearm according to claim 8, wherein a rear end of the firing pin housing comprises a disc element, the firing pin having a wider portion arranged to be biased against said disc element by means of a firing pin spring, the firing pin further having a rear portion thinner than said wider portion, the disc element comprising a through hole dimensioned to receive said rear portion, the contact portion of the hammer being dimensioned and arranged so as to enter the through hole when the hammer is in the fire position, so as to push the firing pin against its front position.

10. The firearm according to claim 8, further comprising a first hammer spring arranged to push the hammer from the rear position towards the fire position, and a second hammer spring arranged to push the hammer rearwards from the fire position towards the rear position, the first hammer spring being arranged to exert pressure on the hammer so as to force the hammer towards the fire position during a first portion of movement of the hammer from the rear position to the fire position, and not to exert such pressure on the hammer during a last portion of said movement of the hammer from the rear position to the fire position.

11. The firearm according to claim 10, wherein the first hammer spring is arranged to be prevented from following the hammer to the fire position by a first hammer spring retention means.

12. The firearm according to claim 11, wherein the first hammer spring and the second hammer spring are selected and arranged so that after firing the firearm, the hammer is moved rearwards from the fire position by the second hammer spring, to a neutral position.

13. The firearm according to claim 10, further comprising a pivotally arranged trigger biased against a hammer blocking position and pivotable between said hammer blocking position and a hammer releasing position, the trigger having a hammer contact portion arranged so that when the trigger is in the hammer blocking position, said hammer contact portion can, depending on the position of the hammer, selectively abut against a first retention configuration of the hammer, so as to keep the hammer in the rear position, or against a second retention configuration of the hammer, so as to prevent the hammer from passing from a neutral position, in which the hammer is substantially balanced by the first hammer spring and the second hammer spring, to the fire position.

14. The firearm according to claim 13, wherein the first retention configuration is shaped so that the hammer contact portion can be displaced from a first position, in which the hammer contact portion abuts against said first retention configuration, to a second position, in which it not abuts against said first retention configuration thus allowing the hammer to pass from the rear position to the fire position, by means of pulling the trigger so as to displace it from its hammer blocking position to its hammer releasing position.

15. The firearm according to claim 13, wherein the second retention configuration is substantially hook-shaped for receiving the hammer contact portion in case of the hammer being urged from the neutral position towards the fire position, without the trigger being pulled.

16. The firearm according to claim 13, wherein the trigger is biased against the hammer blocking position by said first hammer spring.

17. The firearm according to claim 13, further comprising a blocking pin displaceable between a trigger blocking position, in which the pin prevents the trigger from moving to the hammer releasing position, and a trigger releasing position, in which it does not prevent the trigger from moving to the hammer releasing position.

18. The firearm according to claim 17, wherein the trigger blocking pin is provided with a recess for receiving a blocking profile of the trigger when the blocking pin is in the trigger releasing position.

19. The firearm according to claim 13, wherein the trigger, the hammer, the first hammer spring and the second hammer spring are arranged in a removable cassette.

20. The firearm according to claim 1, whereby the barrel is provided with a projection arranged for guiding the barrel in a guide groove in the frame part when mounting the barrel to the frame part.

21. The firearm according to claim 20, wherein said projection comprises a substantially prismatic body fixed to the barrel.

22. The firearm according to claim 21, wherein the projection comprises at least two threaded holes for receiving respective screws by means of which the barrel is fastened to the frame part.

23. The firearm according to claim 22, wherein the barrel is provided with a further projection including a threaded hole for receiving a screw by means of which a barrel-protector is fastened to the barrel.

* * * * *